US007284495B2

(12) United States Patent
Seiford, Sr.

(10) Patent No.: US 7,284,495 B2
(45) Date of Patent: Oct. 23, 2007

(54) SHAFTLESS RADIAL VANE ROTARY DEVICE AND A MARINE PROPULSION SYSTEM USING THE DEVICE

(76) Inventor: Donald S. Seiford, Sr., 14312 Vista Del Lago Blvd., Winter Garden, FL (US) 34787

( * ) Notice: Subject to any disclaimer, the term of this patent is extended or adjusted under 35 U.S.C. 154(b) by 0 days.

(21) Appl. No.: 11/396,919

(22) Filed: Apr. 4, 2006

(65) Prior Publication Data

US 2006/0222526 A1 Oct. 5, 2006

Related U.S. Application Data

(60) Provisional application No. 60/594,394, filed on Apr. 4, 2005.

(51) Int. Cl.
*B63H 25/46* (2006.01)

(52) U.S. Cl. ..... 114/151; 440/5; 440/67

(58) Field of Classification Search ..... 114/151; 440/5, 66, 67; 415/91, 170.1; 416/177, 416/189; 417/405
See application file for complete search history.

(56) References Cited

U.S. PATENT DOCUMENTS 3,441,088 A * 4/1969 Levy ..... 415/74
3,918,389 A * 11/1975 Shima ..... 440/38
5,722,864 A * 3/1998 Andiarena ..... 440/5
5,733,113 A * 3/1998 Grupping ..... 418/188
6,769,886 B2 * 8/2004 Henderson ..... 418/2

* cited by examiner

*Primary Examiner*—Sherman Basinger
(74) *Attorney, Agent, or Firm*—Ronald E. Greigg

(57) ABSTRACT

A radial vane fluid motor or pump has an open ended tubular rotor having a cylindrical outer surface rotatably mounted in a tubular stator having its inner surface contoured to provide successive portions of increased and decreased spacing relative to the rotor body. A plurality of elongated movable vane assemblies are mounted on and project outwardly from the rotor surface to continuously contact the stator surface. Bearings support the rotor within the stator, and seals are provided for sealing the space between the rotor and stator. Pressure inlets and exhaust ports are provided in the stator to permit the flow of pressure fluid into or out of the device. Mounting the vanes on the cylindrical rotor surface enables production cost reduction and simplifies maintenance. A conventional propeller mounted in the cylindrical rotor provides an improved shrouded propellor propulsion system for marine vessels. Mounting the system on a vessel for rotation about an axis perpendicular to the axis of the rotor enables steering of the vessel without use of a rudder.

18 Claims, 14 Drawing Sheets

SHAFTLESS RADIAL VANE ROTARY DEVICE AND A MARINE PROPULSION SYSTEM USING THE DEVICE

CROSS-REFERENCE TO RELATED APPLICATIONS

This application is based on U.S. Provisional Application No. 60/594,394 filed on Apr. 4, 2005.

BACKGROUND OF THE INVENTION

1. Field of the Invention

This invention relates to an improved shaftless radial vane rotary device such as a fluid motor, fluid pump, compressor or the like, and to an improved marine propulsion system using the device as a drive motor. The propulsion system includes a propeller having its blade tips rigidly joined to the inner periphery of an open-center tubular rotor of the device, with the stator being adapted to be joined to and supported on the hull of a marine vessel.

2. Description of the Prior Art

Radial vane rotary devices such as motors, pumps and compressors are known in which a plurality of equally spaced vanes are mounted in radial slots in a cylindrical rotor body and are biased outwardly from the rotor into contact with the inner surface of a stator. Various configuration of the rotor and stator are known; for example, a cylindrical rotor may be mounted with its axis offset relative to the central axis of the stator, or the rotor and stator may be coaxial, with the stator having a contoured surface cooperating with the movable vanes to provide expanding and contracting chambers upon rotation of the rotor. For example, the stator surface may be or oval an elliptical shape or may have a number of lobes around its inner surface.

The vane-supporting slots of the known device have been difficult and expensive to produce in that they have generally been machined into a relatively large body of rigid material, usually metal, and smooth surfaces are necessary to minimize friction with the sliding vanes. Also, the grooves have to be accurately dimensional to control the flow of fluid along the surfaces of the vanes in the grooves. To assure continuous contact while avoiding excessive pressure between the vane edges and the stator surface, it is known to vent the bottoms of the grooves.

U.S. Pat. No. 6,106,255 discloses a radial vane rotary motor in which the vanes are supported in radial slots in a rotor body supported on a shaft for rotation in a rotor chamber defined by a cylindrical stator body having its ends closed by end plates. Grooves in the end plates are provided to facilitate venting of trapped fluid from beneath the movable vanes. This patent also discloses the use of grooves in the vanes for relieving excess pressure from beneath the slots.

U.S. Pat. No. 6,629,829 also discloses a radial vane rotary motor including vents through spring biased end plates to vent the vane supporting grooves. The vents communicate with a pressurized fluid chamber in the stator body.

Various systems have also been developed in a attempt to improve propeller performance and propeller drive efficiency in marine vessel propulsion. The shrouded rudder in which the propeller is driven inside a fixed or pivotable shroud, such as the well-known Kort rudder, is one example.

It is also known to rigidly join the propeller blade tips to the inside surface of a peripheral rim in spoke-like fashion, with the rim being driven for rotation to apply the driving force to the propeller. U.S. Pat. No. 472,199 discloses such an arrangement in which the outer periphery of the rim is provided with vanes, or buckets, with nozzles directing streams of pressurized water into the vanes to drive the propeller in waterwheel fashion.

U.S. Pat. No. 3,487,805 discloses a propulsion system in which a propeller-supporting rim is mounted for rotation in a nozzle by a water-lubricated rubber bearing and is driven by a gear mechanism including a drive gear extending around the periphery or the rim. The rim-supported propeller rotates about a fixed axis, and a blade rudder is positioned behind the propeller for steering.

U.S. Pat. No. 5,722,864 discloses a rim-mounted propeller in which the rim is the rotor of a tubular hydraulic motor. Sleeve bearings are used to rotatably support the rotor in the stator, but no bearing arrangement is disclosed for transferring the propeller thrust to the stator and from the stator support struts to the vessel. Rubber seals are employed to keep water out of the motor. Movable vanes are employed on the rotor, with camming means on the stator depressing the vanes between the inlet and exhaust ports.

U.S. Pat. No. 4,831,297 discloses a propeller drive system in which the propeller blade tips are mounted on the inner periphery of a tubular rotor disposed inside the stator of an electric motor. Hubs at each end of the stator have spoke-like members attached to and supporting the rotor, and a flange is provided on one hub for rigidly mounting the structure to a vessel. This rotor and propeller are rotatably supported by a cylindrical, or journal bearing on a shaft extending between the two stator hubs.

U.S. Pat. No. 5,967,749 discloses a marine vessel propulsion system in which a variable pitch propeller has the inner ends of its blades pivotably supported on a shaft-mounted hub and its outer ends joined by pins to first and second surrounding rings. Permanent magnets are mounted on one of the rings, and coils on the other ring may be supplied with current to rotate the rings relative to one another to vary the pitch. As with the other patents mentioned above, a separate rudder system would be required for steering the vessel.

While the rimmed propellers of the prior art, discussed above, would appear to be efficient in converting the propeller drive force to thrust, these devices have not met with wide-spread acceptance for various reasons. For example, all would appear to present severe maintenance problems, particularly in the use of sleeve bearings or the like for transmitting thrust, as well as in providing adequate lubrication of movable parts. The prior art sealing arrangements, particularly for electrically driven systems, present serious problems. Further, the known rim mounted propellers generally require separate rudder systems for steering, and generally have not been energy efficient. Accordingly, it is a primary object of the present invention to provide a hydraulic motor driven rimmed propeller system which overcomes the shortcomings of the prior art systems.

Another object is to provide such a system suitable for use both as a primary propulsion system and as a side thruster for vessels.

Another object is to provide a rim mounted propeller system driven by a hydraulic motor, utilizing the rim as a rotor, which is economical both to manufacture and to maintain.

Another object is to provide such a system in which the rotor is mounted in the stator utilizing ball bearing assemblies on each end which are capable of carrying both radial and axial thrust loads and which are lubricated by the hydraulic fluid used to drive the motor.

Another object is to provide such a system which utilizes a standard spring loaded, self-adjusting marine packing gland as a water/oil seal, thereby avoiding the use of custom-made rubber seals.

Another object is to provide such a system utilizing a hydraulic motor having movable, spring loaded vanes which have pressure ports assisting the springs in maintaining the movable portion of the vanes in contact with the stator inner surface, and pressure relief ports which assist in lubricating the face of the vane which contacts the stator surface.

Another object is to provide such a system including a pivotal mounting structure rigidly joined to the stator for supporting the motor for rotation about its vertical axis, thereby eliminating the need for a separate steering rudder for the vessel.

Another object is to provide such a system in which the major components of the hydraulic motor are constructed from standard structural shapes to thereby reduce manufacturing costs.

Another objection is to provide an improved radial vane rotary device having spring-loaded vanes supported for substantially radial movement on the rotor, which vanes have pressure ports and/or shuttle valves for assisting the springs in maintaining the vanes in contact with stator surface while assuring freedom of movement of the vanes during rotation of the rotor.

Another object is to provide such a device which is economical to manufacture and easy to maintain.

Another object is to provide such a device in which the radial vanes are mounted in guides attached to the outer cylindrical surface of a rotor body mounted within the stator.

SUMMARY OF THE INVENTION

In the attainment of the foregoing and other objects of the invention, an important feature resides in providing a radial vane rotary device having an open ended generally cylindrical rotor rotatably mounted in a generally cylindrical stator. The rotor comprises a cylindrical drum or shaft having a plurality of rotor vanes mounted in equally spaced relation around it's outer surface rotor. The vanes each include an elongated guide member or members mounted on the drum outer surface by suitable means such as mounting pins or by welding to define an outwardly open, elongated channel for receiving and guiding a radially movable stator contact member or vane. A plurality of spring members are positioned in the channel continuously urge the contact members radially outward into continuous contact with the inner surface of the stator.

In a first embodiment in which the radial vane rotary device is employed as a drive motor for delivering axial thrust as in a marine propulsion system, a pair of thrust bearings capable of transmitting both radial and axial loads are mounted one in each end of the stator and support the rotor for rotation therein. The thrust bearings each comprise an inner race in the form of a rigid ring mounted adjacent the end of the rotor for rotation therewith, and an outer race rigidly attached to the stator, with bearing elements such as balls or rotors disposed between the inner and outer races for rotatably supporting the rotor and transferring axial thrust loads from the rotor to the stator.

A seal cap is mounted on each outer race and cooperates therewith to define a packing gland for receiving a marine packing material to seal the interior of the motor chamber. Resilient means is provided to mount the seal cap to the outer race to thereby maintain the desired pressure on the packing material to assure a reliable seal.

In a first embodiment, a plurality diameter reducing elements or ramps, are mounted on the inner surface of the stator and extend the length thereof between the thrust bearings. The ramps have arcuate inner and outer surfaces concentric with the opposed stator and rotor cylindrical surfaces, and have their longitudinal edges tapered to provide ramp areas enabling the contact member of the vanes to be cammed inwardly and to smoothly expand as the rotor rotates in the stator.

In this embodiment, two channel-shaped hydraulic fluid conduits extend around the outer circumference of the stator in axially spaced relation to one another, and a conduit connected to each channel provides a flow path to or from the channels. Fluid ports extend from the channels through the stator wall and through the diameter reducers in the ramp areas. Depending on the direction of rotation, all ports from one channel extend through the leading edge ramp portions of the diameter reducers, and all ports from the other channel extend through the trailing edge ramp portion. The vanes divide the annular space between the rotor and stator into a plurality of pressure chambers, and the number of vanes and the distance between the ports in the leading and trailing ramps of each diameter reducer are selected such that at least one vane is in contact with and compressed by a diameter reducer and at least one is in contact with the stator surface between each pair of diameter reducers at all times. Thus, when pressure fluid is directed through a port adjacent a compressed vane having a reduced area exposed to the fluid pressure, the rotor will be driven by the adjacent vane which is not compressed and therefore has a greater area exposed to the pressure.

By directing pressure fluid through its connecting conduit to one of the pressure channels and connecting the other channel, via its connecting conduit, to a sump, as a vane defining a pressurized chamber moves into contact with a ramp, the port on that ramp will be opened to the sump and a portion of the fluid will be returned as the vane defining the trailing edge of the chamber moves over the diameter reducer. At the same time, fluid pressure will enter the proceeding chamber as that vane progresses over the diameter reducer.

In a second embodiment which is particularly well suited for use as a pump or as a motor for delivering rotary drive force to a driven component, but which is equally well suited for delivering axial thrust as in the marine propulsion system, the generally cylindrical stator surface contacted by the vanes has an elliptical or oval shape in cross section, with the portion of the oval having the longer radius of curvature acting as the diameter reducers. In this embodiment, only two inlet and two outlet ports are used, wherein in the first embodiment referred to above, a greater number—for example, four—inlet and outlet ports, with an equal number of diameter reducers, may be employed. When employed as a pump or rotary drive motor, axial thrust bearings may be employed.

In a marine propulsion system embodying a drive motor according to this invention, the rotor drum is in the form of a cylindrical drum or pipe section which surrounds a marine propeller which may be of conventional blade design and have its blade tips rigidly joined, as by welding or bolting, to the inner periphery of the drum so that the rotor and propeller form a rigid assembly.

A support post, preferably in the form of cylindrical pipe or tube, is rigidly joined, as by welding, to the outer periphery of the stator for supporting the motor and propeller. This support post may extend through the hull of a vessel and be mounted for rotation about its longitudinal axis to turn the motor and propeller in any direction, thereby eliminating the need for a rudder to steer the vessel or the need to stop and reverse the motor for backing thrust. Also, the pressure conducts connected to the pressure channels, which conduits preferably pass through the support post, are capable of being rotated, as by a suitable swivel connection. Alternatively, flexible conduits may be employed which enable limited rotation of the propeller and motor about the support post axis. By rotating the motor and propeller through 180°, reverse thrust is applied to the support post. Alternatively, the motor and propeller may be reversed by reversing the flow of hydraulic fluid through the motor.

BRIEF DESCRIPTION OF THE DRAWINGS

Other features and advantages of the invention will become apparent from the detailed description contained herein below, taken in conjunction with the drawings, in which.

DESCRIPTION OF THE PREFERRED EMBODIMENTS

Figure 1:
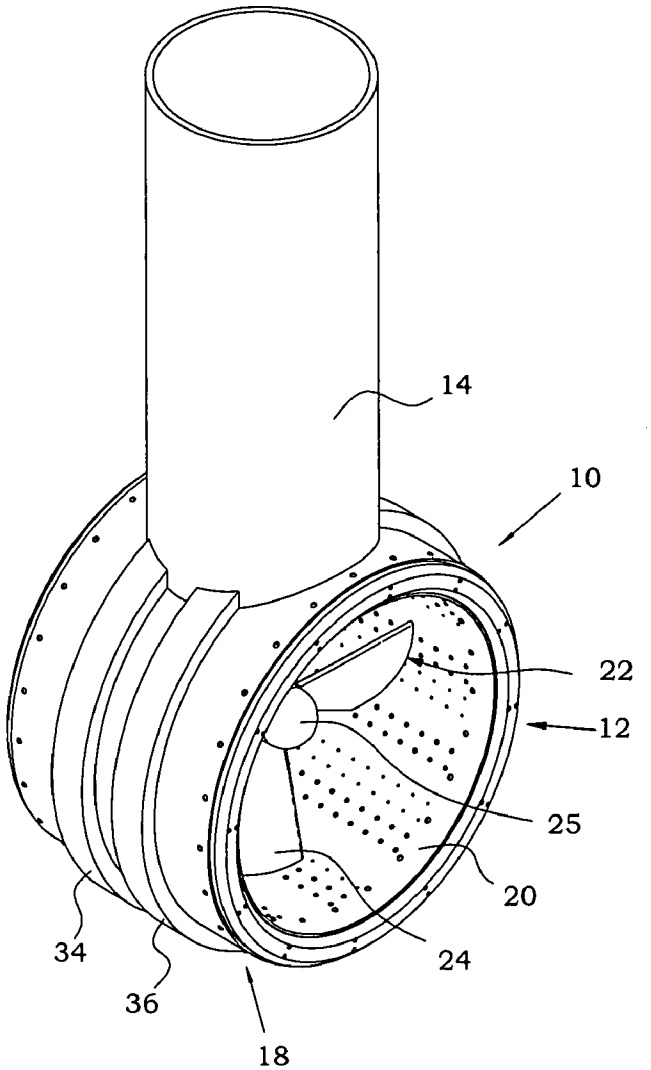
FIG. 1 is an isometric view of a first embodiment of the marine propulsion device according to the invention.
Figure 2:
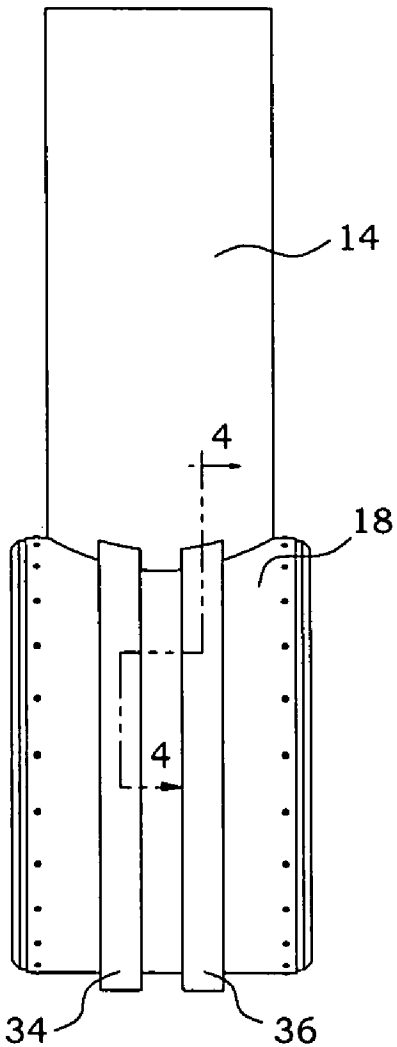
FIG. 2 is a side elevation of the device shown in FIG. 1.

Referring now to the drawings in detail, a first embodiment of a radial vane rotary motor embodying the invention is illustrated as a drive unit for a marine propulsion system designated generally at 10 in FIG. 1, and includes a cylindrical tubular hydraulic motor 12 supported on a hollow, preferably cylindrical support post 14 which, in use, projects through the hull of a vessel (not shown) and is supported for pivotal or rotary movement about its longitudinal or vertical axis 16. The motor 12 consists of a generally cylindrical stator 18 rigidly mounted, as by welding, on the downwardly projecting end of support post 14, and a rotor 20 rotatably mounted in stator 18.

Figure 3:
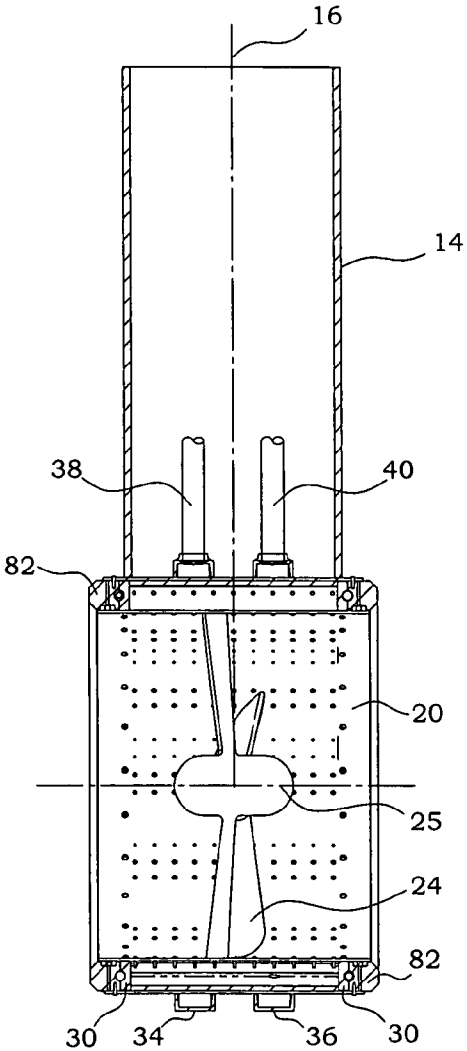
FIG. 3 is a longitudinal, vertical sectional view, to a larger scale, of the structure shown in FIG. 2.

As best seen in FIGS. 1 and 3, the rotor 20 includes a propeller 22 having a plurality of blades 24 supported on a hub 25. Propeller 22 may be of a standard or commercial marine propeller design, with the tips of the blades 24 rigidly joined, as by welding or bolting, to the inner periphery of a tubular rotor body 26 which is preferably a length of standard seamless pipe or tubing of a suitable corrosion resistant metal. A plurality of elongated collapsible vanes assemblies, indicated generally by the reference number 28, are mounted on the outer peripheral surface of the rotor body 26 with their longitudinal axis parallel to the central axis of the motor 12.

Rotor 20 is rotatably mounted by a pair of anti-friction bearing assemblies 30, one at each end portion of the rotor body 26, in the stator 18. The stator includes a cylindrical body 32, also preferably a length of standard seamless pipe or tubing of suitable corrosion resistant metal, with a pair of axially spaced, channel shaped hydraulic fluid supply rings 34, 36 extending around its periphery in belt-like fashion, one offset in each direction from the transverse center plane of the motor. A pair of fluid conduits 38, 40 are connected one to each of the rings 34, 36 for supplying fluid under pressure to the motor 12 and to return the fluid to a supply source, not shown. Conduits 38, 40 preferably are located in the support post 14 and are connected in a reversible fluid circuit to a high pressure pump not shown, located in the vessel.

A plurality of elongated diameter-reducing element 42 are mounted on the inner surface of stator body 32 in equally spaced relation around its periphery. The elements 42 have arcuate inner and outer surfaces 44, 46, respectively, with their center of curvature corresponding to that of the rotor body 26 and stator body 32, and with the inner arcuate surface 44 having a width less than that of the outer surface 46. The lateral edges of the diameter reducers 42 are tapered to provide ramp areas 48, 50 which act as cam surfaces guiding the movable vanes 28 for radial movement as more fully described below. The diameter reducers 42 may be formed from flat metal stock bent to the desired curvature, or may be formed from segments of a metal pipe or tubing having the desired outside diameter and wall thickness, and having their opposed side edges tapered to provide the desired cam curvature.

Figure 5:
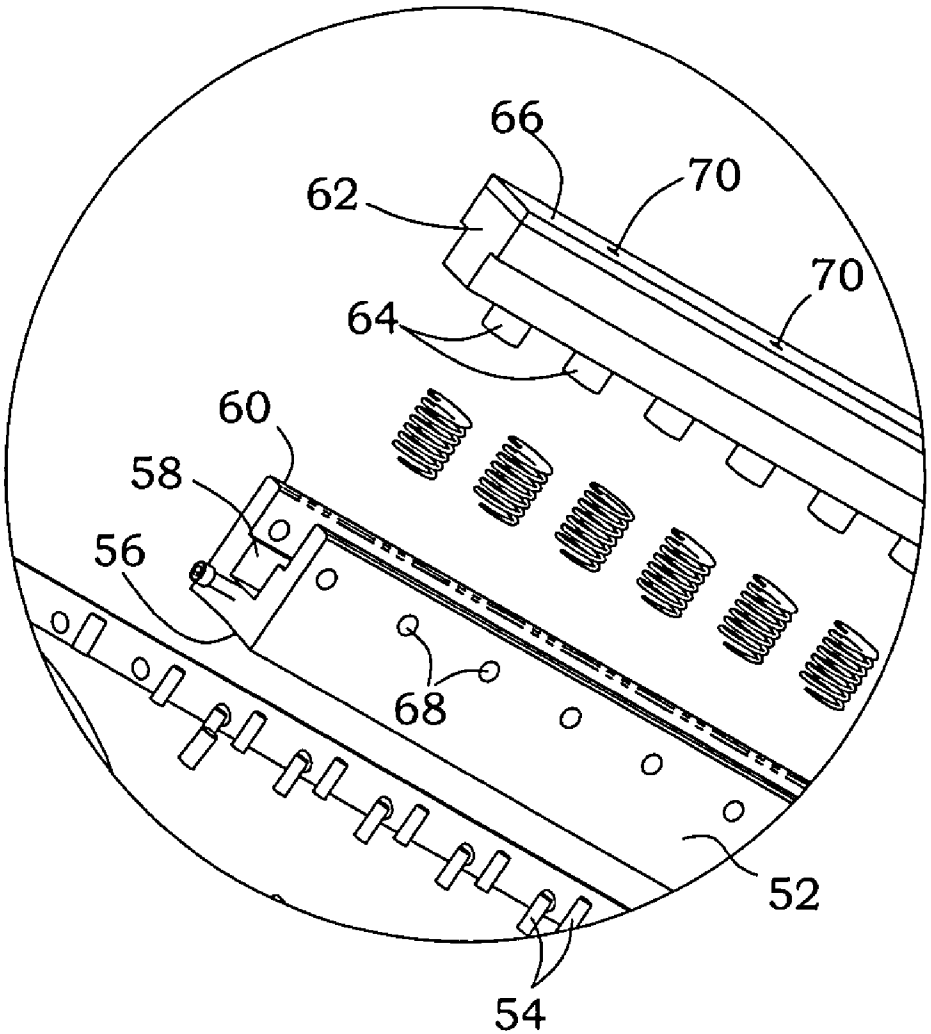
FIG. 5 is a fragmentary exploded view of a first embodiment of the vane structure employed in the radial vane rotary device.

Referring now to FIG. 5, the vanes 28 of this first embodiment each comprise a guide member in the form of an elongated channel-shaped body 52, which may be extruded from a suitable material such as aluminum shape, or machined from standard bar stock. A plurality of pin members, or screw fasteners 54 extend through the body 26 and into the bottom surface 56 of bodies 52 to firmly secure each vane assembly to the rotor. The body 52 has a stepped channel 58, with a wider top portion and a more narrow bottom portion, formed in and extending the length of the body from the top surface 60. A movable elongated vane member 62 of generally T-shaped cross-section is telescopingly received in the stepped channel 58 of the vane body 52. A plurality of guide pins 64 such as allen screws or the like project radially inward from the inner edge of vane members 62 and act as retainers and guides for coil springs 65 received in the narrow section of channels 58 resiliently pressing the vane members 52 radially outward. A friction reducing pad, or slide bearing element 66 is preferably mounted on the radially outer surface of each vane member 62 and is retained in sliding contact with the inner surface of stator body 32 and the diameter reducing elements 42 as the rotor 20 rotates in the stator 18. A plurality of pressure ports 68 extend from the lateral sides of the vane body 52 into the radially outer or wider portion of the stepped channel 58. These ports permit pressure fluid in the motor to enter the channel 58 and press the moveable vane member outward in the areas of the T-shaped overhang. Also, a number of pressure relief ports 70 extend radially through the movable vane elements 62 and the friction reducing pads 66 and provide an escape path for any pressure fluid trapped in the bottom of channel 58 when the vane member is cammed inwardly by the ramps 48, 50.

Figure 6:
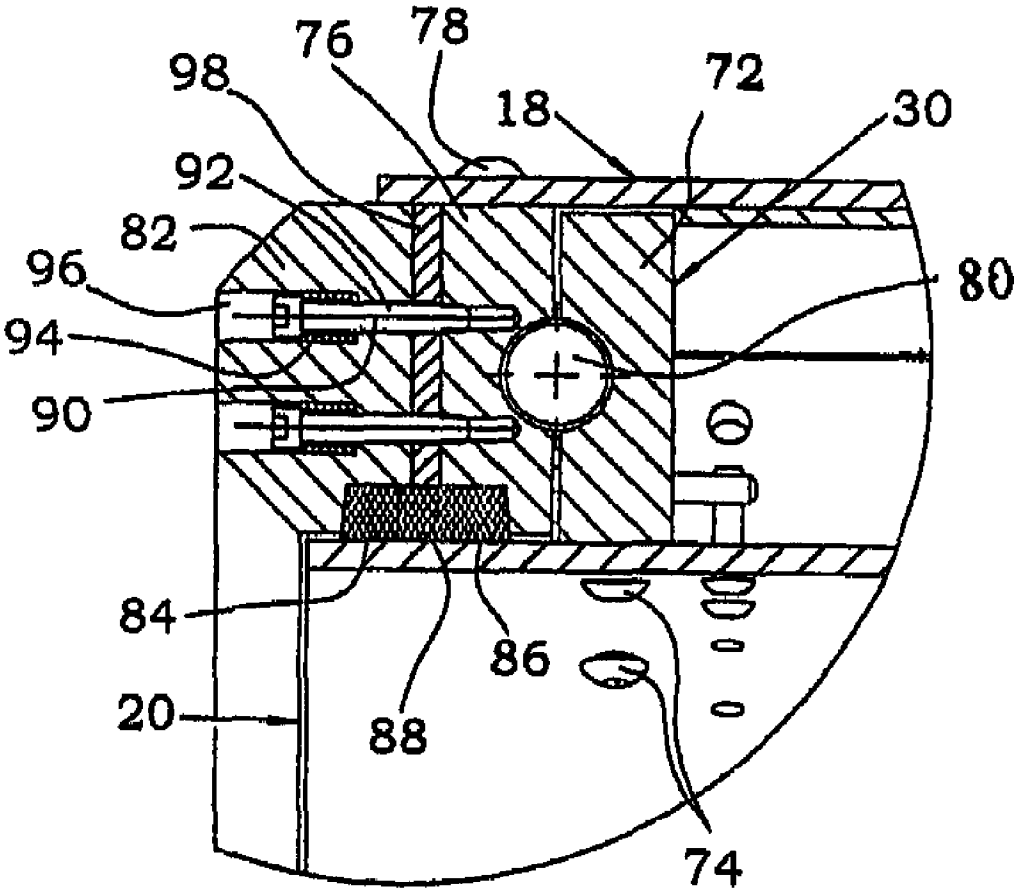
FIG. 6 is an enlarged fragmentary sectional view of the radial and axial thrust bearing and seal assembly employed in the device.

Referring now to FIG. 6, the bearing assemblies 30 each comprise an inner race 72 extending around and mounted directly onto the outer surface of rim 26, by suitable means such as bolts 74, and an outer race 76 similarly mounted by bolts 78 on the inner surface of stator body 32 axially outboard of and in opposed relation to the inner race 72. Ball bearing elements 80 are captured in opposing grooves in the bearing races in position to carry both radical and axial thrust loads.

To seal the motor, a seal cap 82 mounted on the outwardly directed surface of the outer bearing race 76 has a groove 84 formed in its inwardly directed end face at its inner periphery in opposition to a similar groove 86 formed on the outwardly directed face of outer race 76, with grooves 84 and 86 cooperating to form a packing gland receiving a standard marine packing 88. A plurality of bores 90 extend through the seal cap, and threaded fasteners 92 extend through these bores and are received in aligned threaded bores (not numbered) in the outer race 76. Helical springs 94 disposed in counterbores 96 between the heads of fasteners 92 and the seal cap provide a spring-biased pressure through the seal cap to the packing seal. A resilient, compressible washer or gasket 98 may be provided between the seal cap and the adjacent face of the outer race 76.

Figure 4:
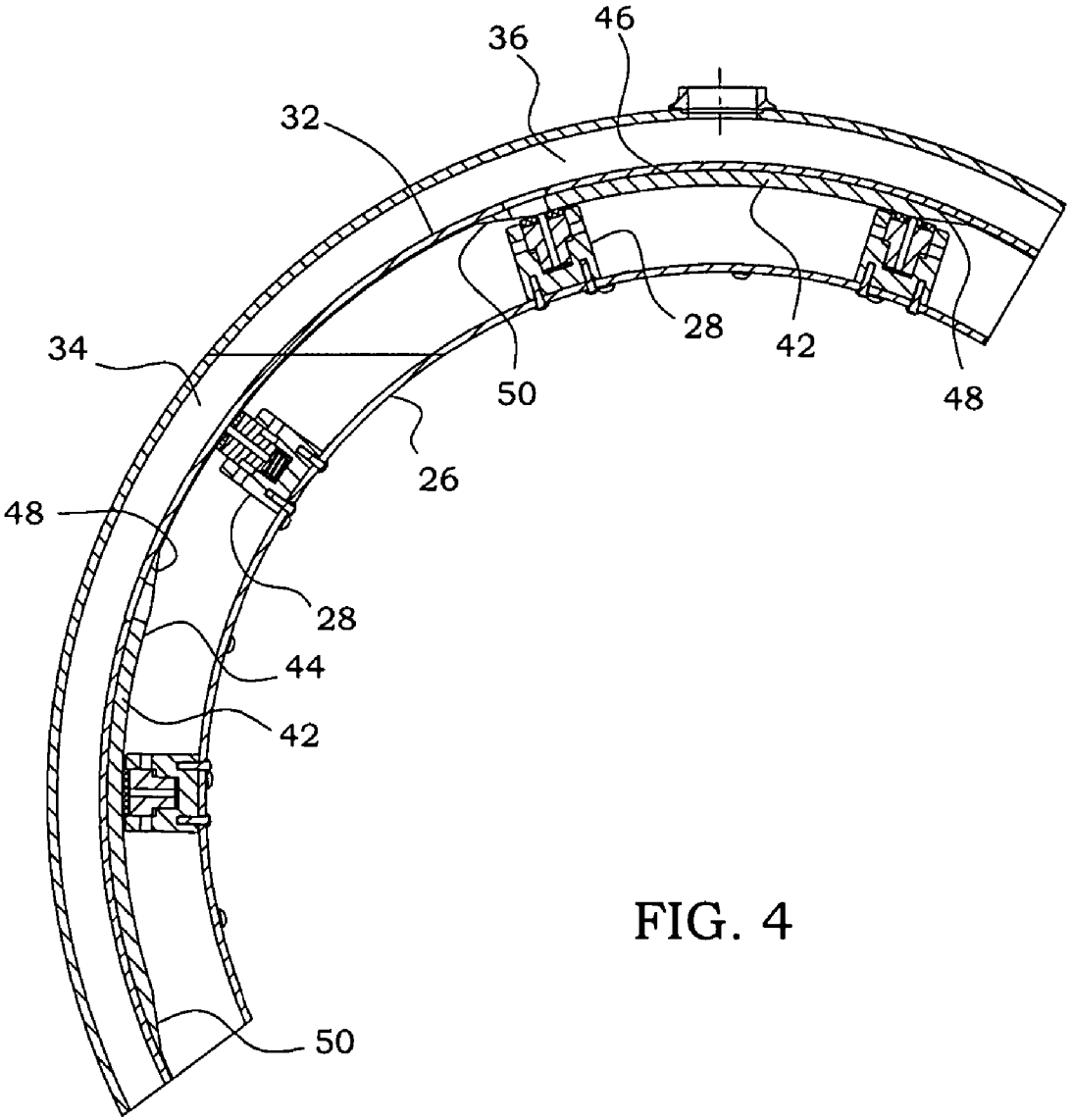
FIG. 4 is an enlarged fragmentary sectional view taken along lines 4-4 of FIG. 2.
Figure 7:
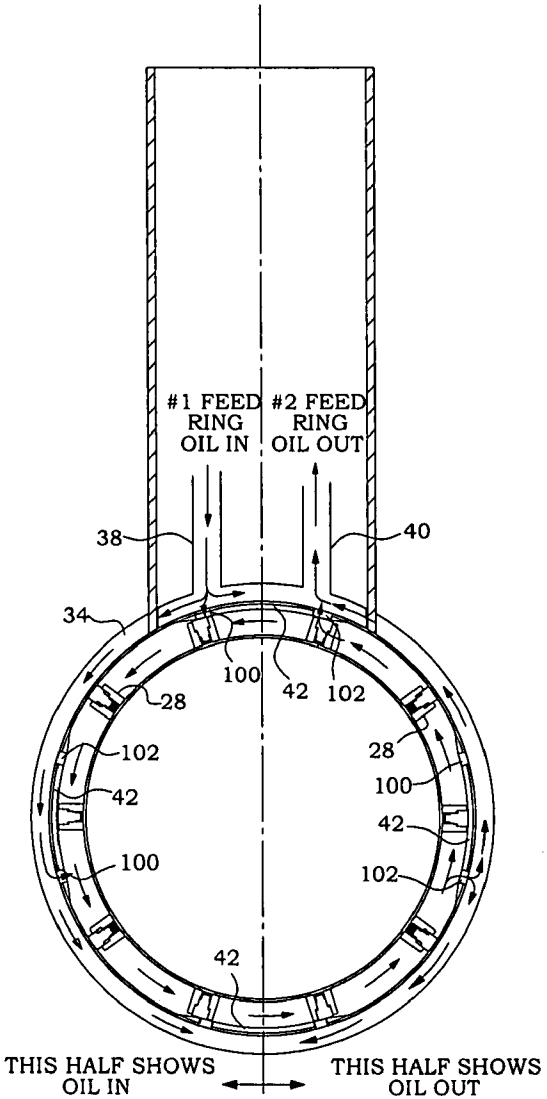
FIG. 7 is a schematic flow diagram showing the flow of hydraulic fluid through the device.

Referring now to FIGS. 4 and 7, it is seen that in operation when fluid under pressure is supplied to the motor 12 through, for example, conduit 38, fluid channel 34 will be pressurized around the enter periphery of the motor. In the embodiment illustrated in FIG. 7, four diameter reducer 42 are positioned at equally spaced intervals around the stator body, and twelve collapsible vanes 28 are mounted on the cylindrical surface of rotor body 26, although these numbers are not critical so long as the number of vanes is at least doubles the number of diameter reducer and so long as a vane assembly 28 has a vane member 62 in contact with and resting upon each diameter reducer and one in contact with the stator between each adjacent pair of diameter reducers at all times. It is pointed out, also, that a smaller number of collapsible vanes will require wider (in the circumferential direction) diameter reducer in order to maintain this relationship.

A fluid pressure port 100 is formed in and extends through the rotor body 26 and through the ramp portion 48 of each diameter reducer 42 from channel 34, and another pressure port 102 is formed in and extends through rotor body 26 and ramp portion 50 of each diameter reducer 42 from channel 36. Thus, pressure fluid in channel 34 will flow through the ports 100 into the annular space between the stator and rotor and, since for each port 100, a vane is in contact with the corresponding diameter reducer 42, the preceding vane, which is not in contact with a pressure reducer will have a greater surface area exposed to fluid pressure, and the rotor will rotate in the direction of the vane with the greater exposed area.

As the rotor rotates to move each vane past the leading edge of a ramp 50, pressure fluid in the chamber between that vane and the next following vane can escape through the port 102 into the channel 36 which now functions as a fluid return. As a vane moves past each return port 102, and is compressed by the diameter reducer, the preceding vane moves past the pressure port 100 to drive the rotor. In one embodiment with four diameter reducers and twelve collapsible vanes, the surface area of the collapsed vanes is ten square inches less than the vanes which are not collapsed. By supplying hydraulic fluid at 1,000 psi to the motor, a theoretical force of 400,00 pounds may be applied to the rotor to drive the propeller. Ignoring friction and pressure losses, with four diameter reducers, four such pressure chambers will act on the rotor shaft at all times, providing a theoretical driving force of 1,600,000 pounds.

It is believed apparent that, by supplying pressure to the channel 36 and connecting channel 34 to sump, the motor will be driven in the opposite direction in the same manner.

Figure 8:
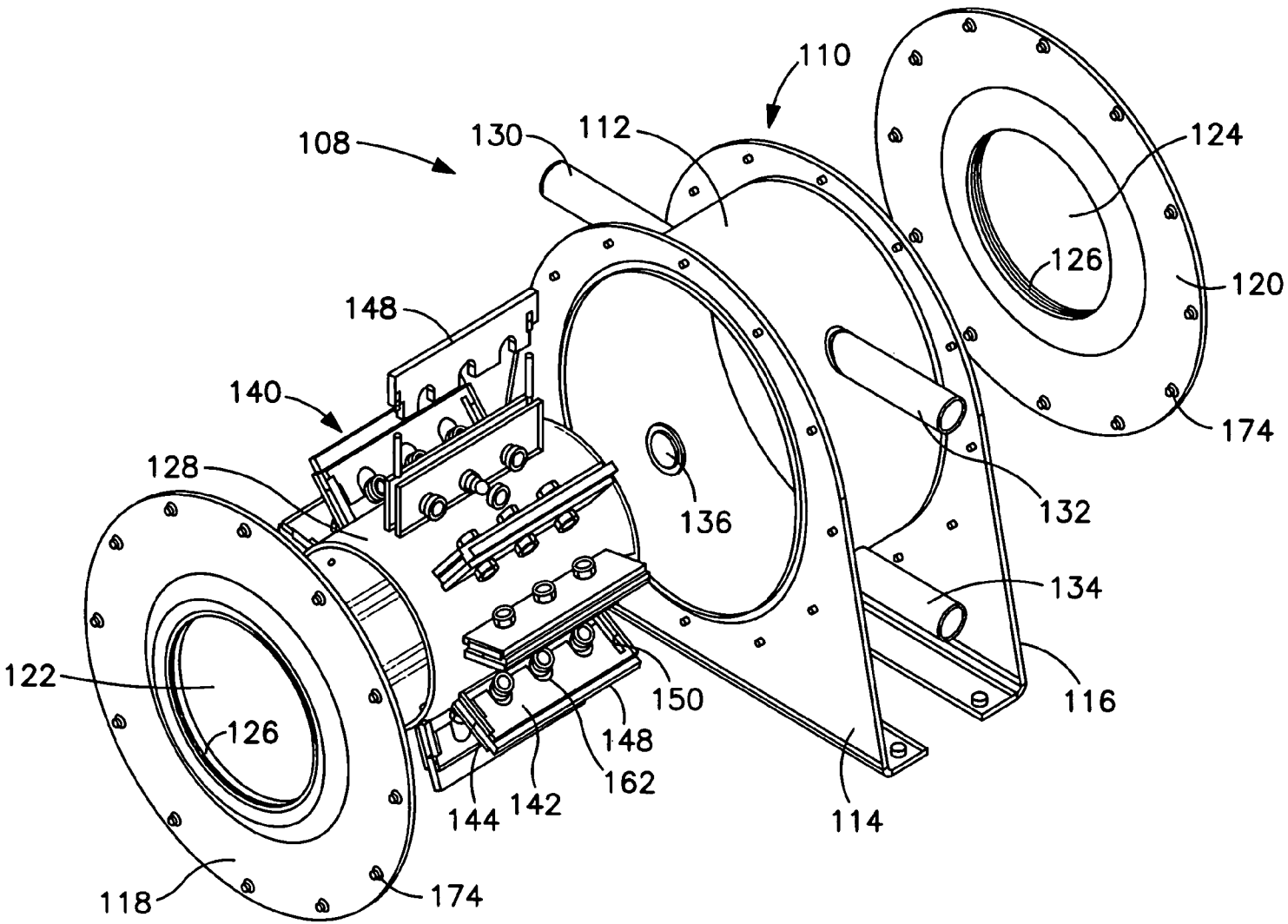
FIG. 8 is an exploded isometric view of a second embodiment of the pump-motor of the invention, embodied as a stationary rotor drive pump or motor.
Figure 9:
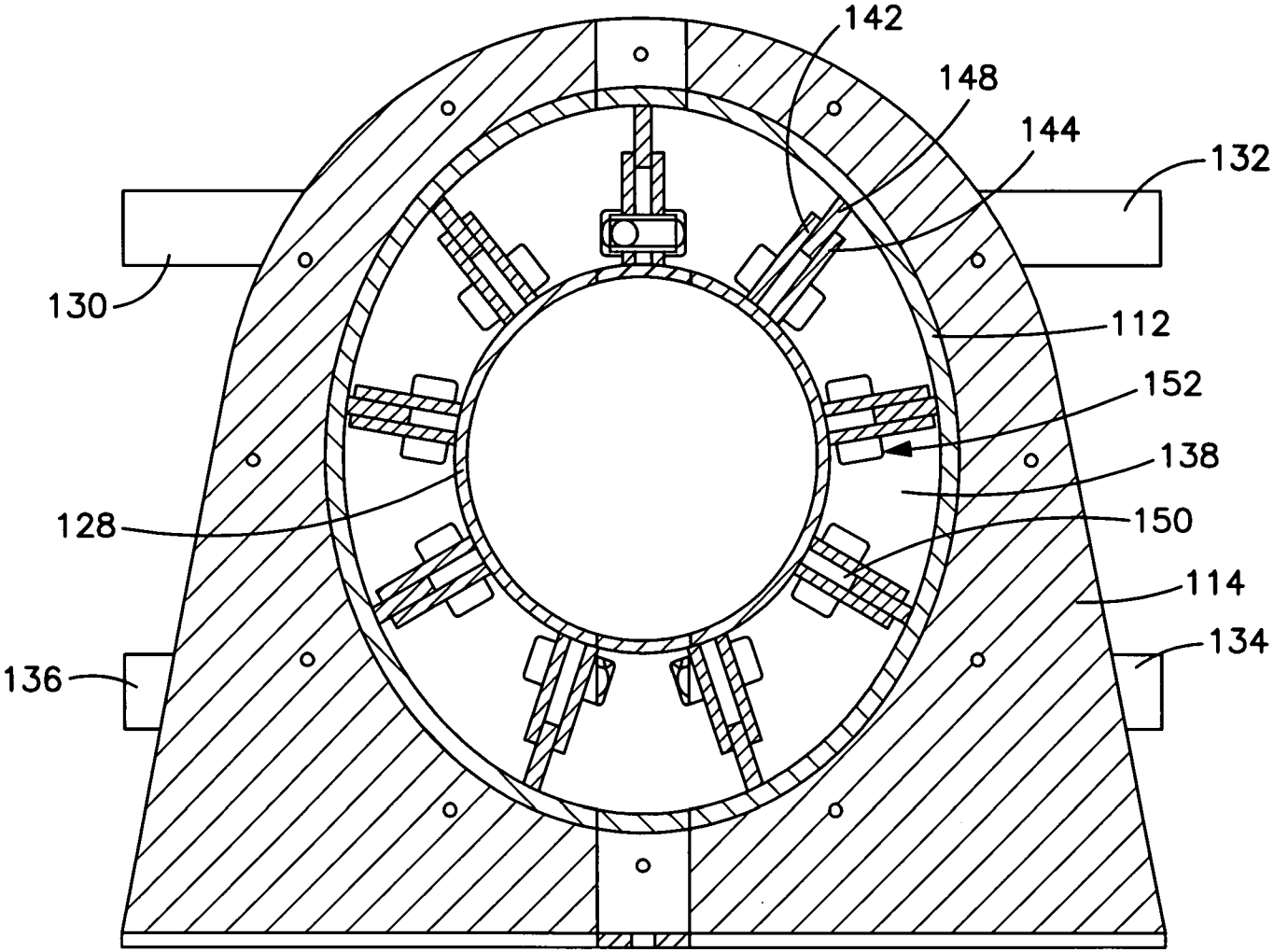
FIG. 9 is a transverse vertical sectional view of the second embodiment of the pump-motor of FIG. 8.
Figure 10:
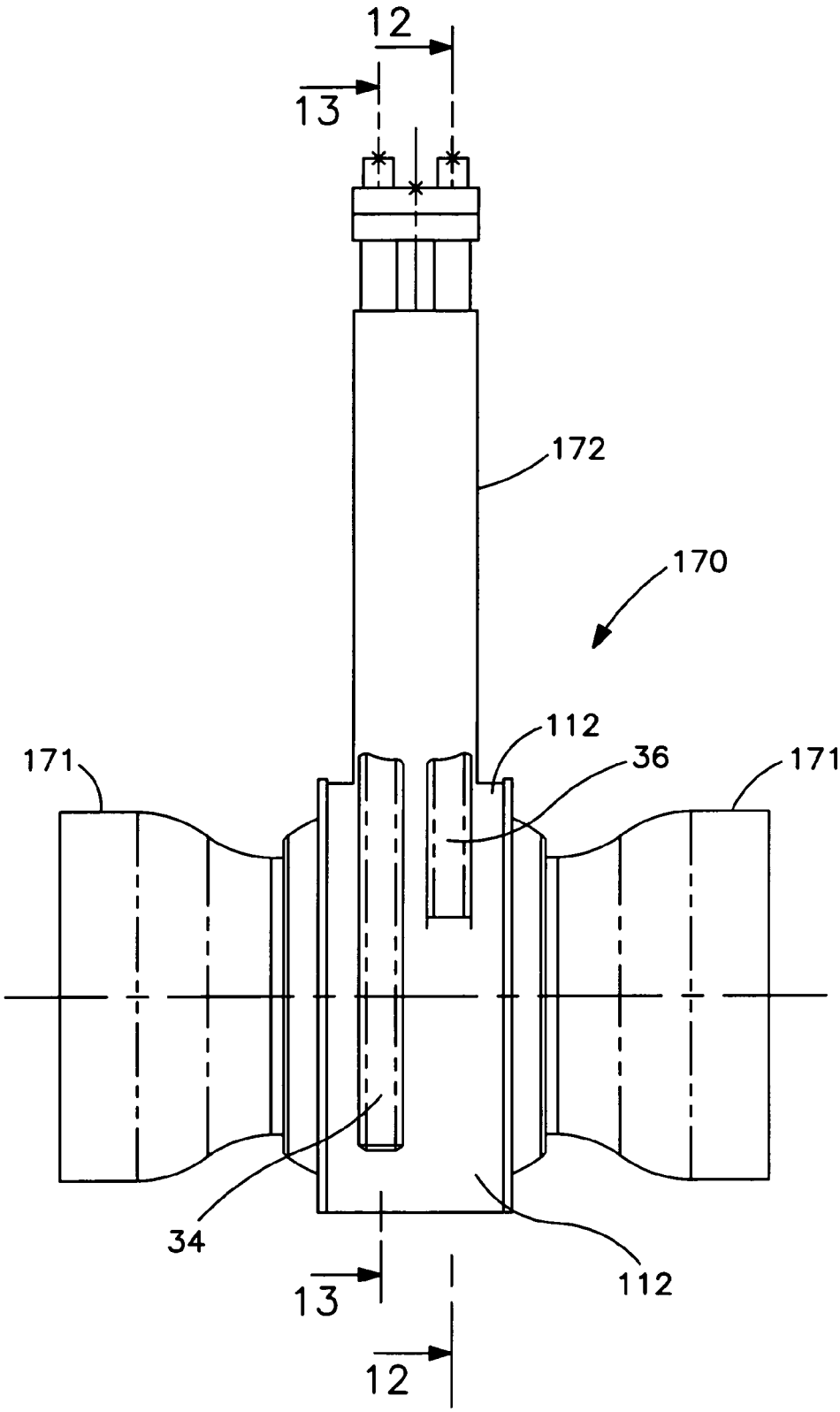
FIG. 10 is an elevation view similar to FIG. 2 showing an alternative embodiment of a marine propulsion system employing the motor of FIGS. 8 and 9.
Figure 11:
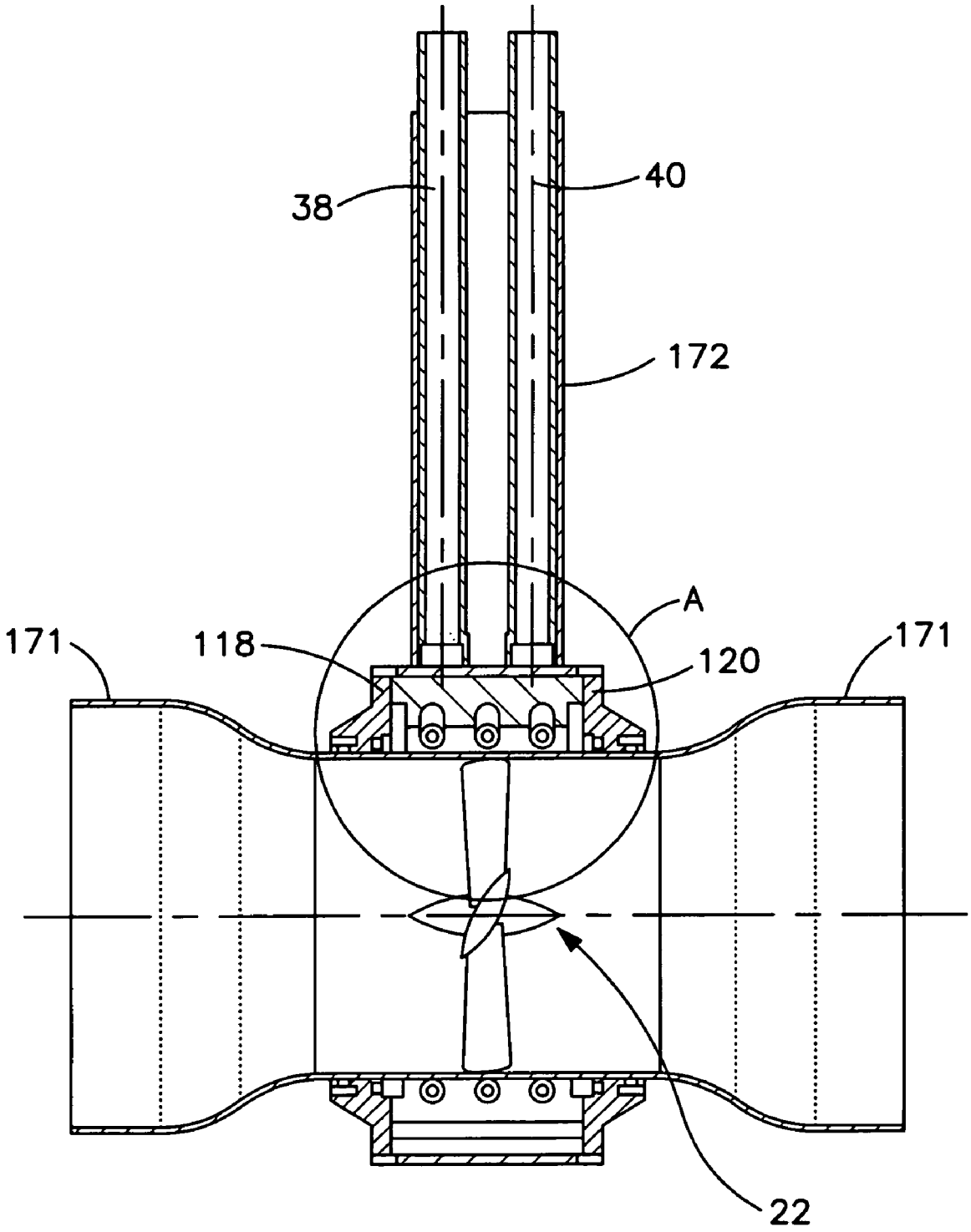
FIG. 11 is a vertical sectional view of the structure shown in FIG. 10.
Figure 12:
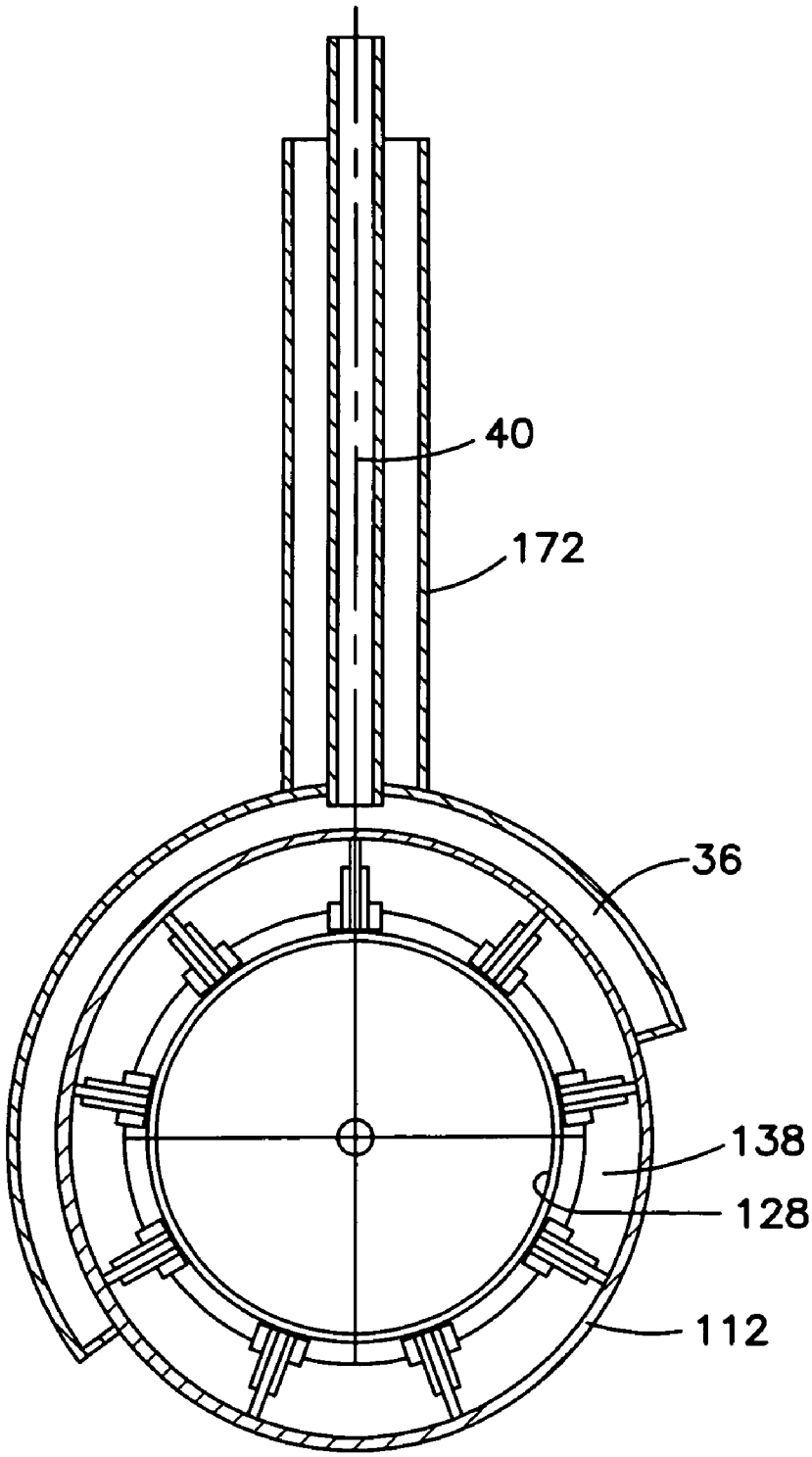
FIG. 12 is a sectional view taken along line 12-12 of FIG. 10.
Figure 13:
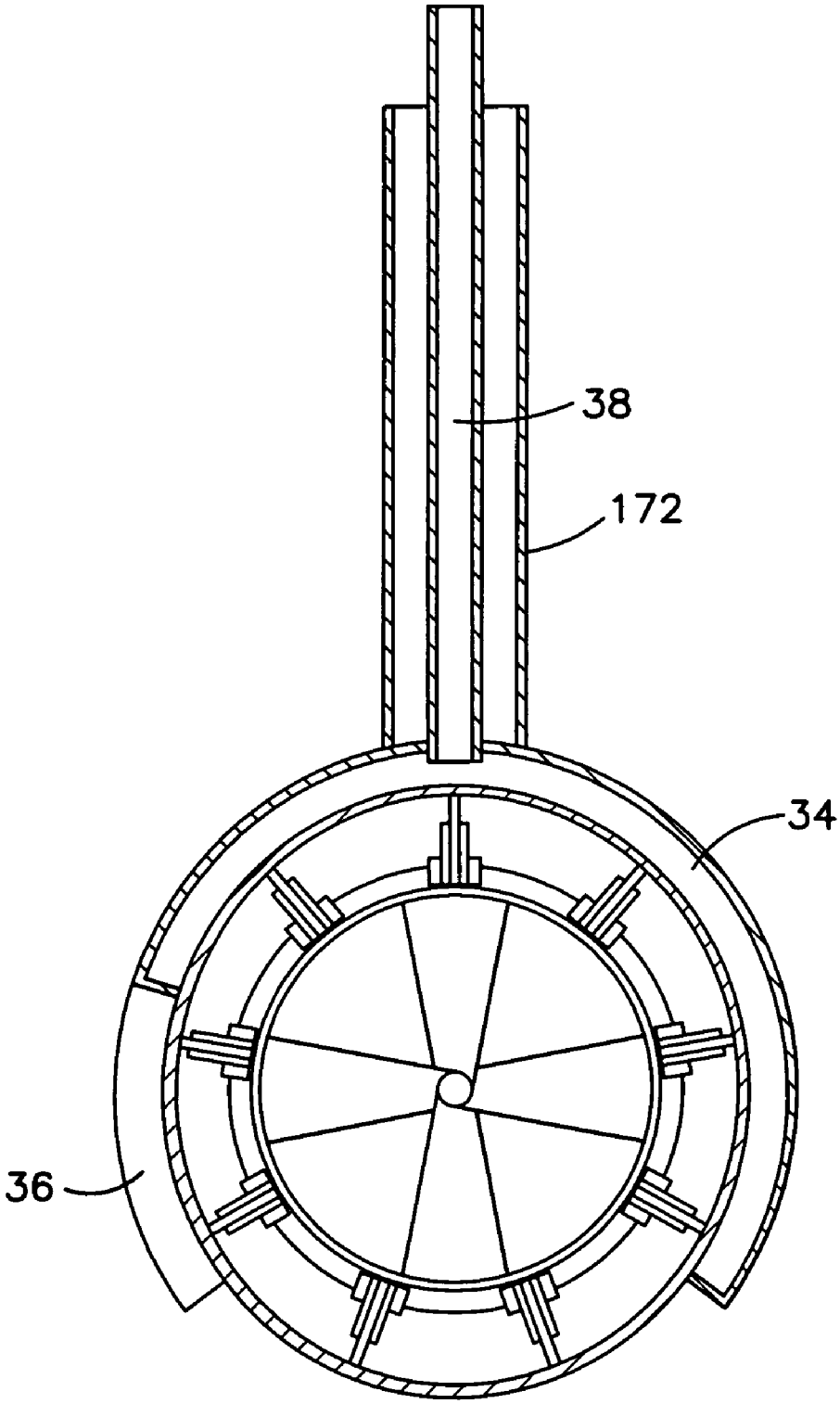
FIG. 13 is a sectional view taken along line 13-13 of FIG. 10.
Figure 14:
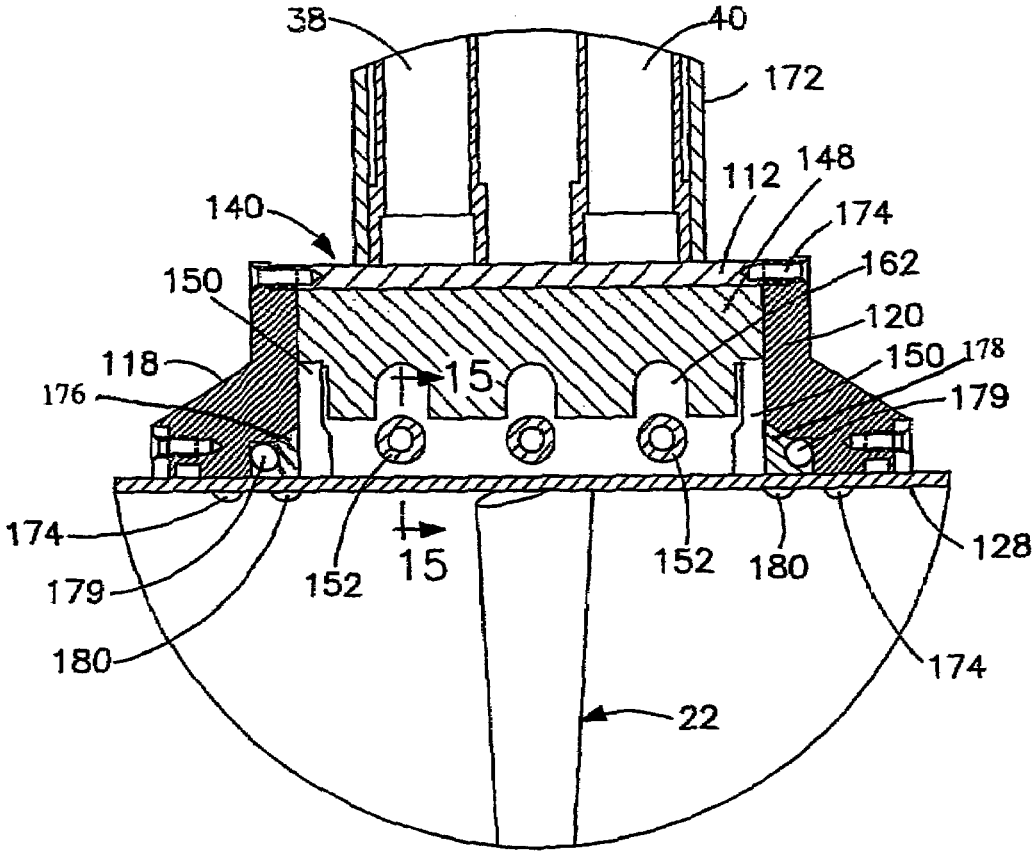
FIG. 14 is an enlarged view of the detail A shown in FIG. 11.

Referring now to FIGS. 8-14, a second embodiment of a radial vane rotary device embodying the invention will be described. In FIGS. 8 and 9, the device is indicated generally by reference number 108 and is illustrated as a stationary motor or pump assembly in which the stator 110 includes a tubular body 112 with support brackets 114, 116 rigidly mounted one adjacent each end of body 112 for attaching the device to a support surface for use. In contrast to the first embodiment described above, stator body 112 has an oval or elliptical shape in transverse cross section, with a continuous smooths inner surface. Annular end plates, or flanges 118, 120 are mounted one on each support bracket 114, 116, with central circular openings 122, 124, respectively, supporting bearing assemblies 126. The opposed end portion of a cylindrical tubular rotor body 128 project through and are supported for rotation within the stator body by the bearings 126.

When the device 108 is used as a pump, or as a stationary motor to deliver rotary power to a driven element, the bearings 126 may be radial bearings, with appropriate seals to contain the fluid pressure within the device. Alternatively, a combined radial and axial thrust bearing such as the bearing assembly 30 described above may be employed to support the rotor body 128.

Four fluid inlets or conduits 130, 132, 134 and 136 are in communication with the fluid chamber 138 between rotor body 128 and stator body 112 at spaced points around the body for delivering fluid to and withdrawing fluid from the device in the conventional manner. For example, when the device is used as a motor, and pressure fluid is delivered through conduits 130, 134 the device will be driven clockwise, and fluid will be discharged through conduits 132, 136 for return to sump. Similarly, when pressure fluid is delivered through conduits 132, 136 the device will be driven counterclockwise and the fluid returned to sump through conduits 130, 134.

When the rotor body is driven clockwise as a pump, the fluid will be aspirated into the device through conduits 132, 136 and pressure fluid discharged through conduits 130, 134, and when driven counterclockwise, fluid is aspirated into the device through conduits 130, 134 and pressurized fluid is delivered from the pump through conduits 132, 136.

A plurality of elongated radial vane assemblies 140 are mounted on the outer peripheral surface of the rotor body 128 at equally spaced intervals therearound. Vane assemblies 140 may be similar in construction to vane assemblies 28 described above or alternatively may be of the less complex and more economical construction more clearly seen in FIGS. 9, 14 and 15. In this alternate construction, each vane assembly 140 comprises a pair of elongated flat bar members 142, 144 rigidly joined, as by welding to the circumferential surface of rotor body in parallel spaced relation to one another to define a channel 146 therebetween for receiving an elongated vane 148 for guided radial sliding movement. Resilient means such as coil springs 150 are received in the channel 146 and resiliently urge the vanes 148 radially outward into contact with the inner surface of stator body 112. Vanes 148 preferably are formed of a low friction material, and the opposed surfaces of bar members 142, 144 may have a low friction coating thereon for contact with the vanes 148. Also, it is believed apparent that the channels 146 may be defined by an open channel member having a common web rigidly attached to the rotor surface as described above with respect to channels 52.

Figure 15:
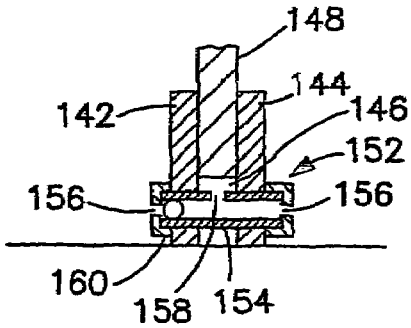
FIG. 15 is an enlarged sectional view taken along line 15-15 of FIG. 14.

Fluid under pressure is maintained in the channels 146 between the rotor body and the vanes to continuously urge the vanes 148 into sealing contact with the inner surface of stator body 112. To maintain this pressure fluid in the channels while enabling the vanes to move radially in and out in their elliptical path around the stator, at least one shuttle valve 152 is mounted in and extends through each pair of flat bars and the channel defined therebetween. As seen in FIG. 15, the shuttle valves comprise an elongated tubular body 154 extending through and supported in openings in the flat bars 142, 144 adjacent the rotor body, with a restricted opening 156 in each end of the valve body, and a further opening 158 centrally of the valve body providing continuous fluid communication with the channel 146 radially inward of the vanes 148. A shuttle cock or ball 160 is retained in the body 154 and permitted to move therethrough to close one opening 156 when pressure fluid flows into the valve body through the other opening. Similarly when the vanes 148 are cammed radially inwardly, fluid can flow out of the channel through the open end of the valve. The shuttle valves provides a simple and expansive means for venting the channels regardless of the direction of rotation of the rotor.

Again referring to FIGS. 8 and 14, the vanes 148 may be provided with notches 162 in their radially inner edge to avoid contact with the shuttle valves while permitting maximum radial movement and support within the channel 146.

Referring now to FIGS. 10-15, a marine propulsion system indicated generally by the reference number 170 and powered by a radial vane motor according to the second embodiment will be described. Operation of this system is similar to the first embodiment described above, and therefore the description of this second embodiment will be directed primarily to the differences between the two systems. It has been found, however, that the system may operate more efficiently when inlet and outlet cones, indicated generally at 171, are provided on the ends of rotor body to provide a greater water flow through the motor and to reduce the back pressure downstream of the propeller. Cones 171 may be employed on both embodiments of the system if desired. Thus system 170 includes a generally vertical support post 172 having the stator 112 rigidly joined to its bottom end as in the first embodiment, and flanges 118 and 120 and removably joined to the opposed ends of the elliptical stator body as by threaded fasteners 174. The bearing assemblies 126 are combined radial and axial thrust bearings and comprise outer races integrally formed on the flanges 118, 120 and inner races 176, 178 mounted on the outer periphery of rotor body 128 as by fasteners 180. Anti-friction balls 179 are supported in races between the inner and outer races, packing seals of the type described above are mounted on the flanges to seal the motor 109. A bladed propeller 22 is rigidly mounted in the rotor body as described above.

Fluid under pressure is directed to motor 108 and returned from the motor through the fluid supply conduits 38, 40 connected to channel shaped supply rings 34, 36 mounted on and extending partially around stator 112. Rings 34, 36 are in fluid communication with the fluid ports 130, 132, 134 and 136 in the marine. In this embodiment, it is only necessary for the supply conduits 38, 40 to each extend slightly over one half the circumference of the stator body and provide a fluid communication with the two ports providing inlets and outlets, respectively, to the chambers 138.

In operation, as fluid under pressure enters the chamber 138 through ports 130, 134, this fluid pressure will move the shuttle valve ball to the end of valve body opposite the portion of the chamber being pressurized to prevent the flow of pressure fluid through the valve. At the same time, the pressure fluid can flow from outlet 158 to apply pressure to the radial inner edge of vane 148 to assure sealing contact between the vane and the inner surface of stator 112. As the rotor moves the vanes toward the reduced radius of the elliptical stator and the vanes are cammed inward, the fluid can flow back out of the valve without producing undesired pressure build-up beneath the vane. When the motor is driven in reverse, the ball in the shuttle valve will simply shift to the other end of the valve body and function in the same manner. Thus, a substantially constant fluid pressure is maintained beneath the radial inner edge of the vanes urging them into contact with the stator surface regardless of the direction of rotation or the position around the stator surface.

While preferred embodiments have been disclosed and described, it is to be understood that this invention is not so limited. For example, while the motor/pump assembly has been described specifically in conjunction with a marine propulsion system the device may generally be used where ever fluid motors a pump are used. Further other systems employing shaftless propellers may have use, for example for stirring or mixing of liquids in storage tanks or the like. Accordingly, it is intended to include all embodiments of the invention which would be apparent to one skilled in the art and which come within the spirit and scope of the invention.

I claim:

1. A shaftless radial vane rotary device comprising, a stator adapted to be mounted to a support structure, a rotor mounted for coaxial rotation within said stator, said rotor including an elongated generally tubular body with a cylindrical outer surface and open ends, said stator including an elongated generally tubular body having open ends and a smooth inner surface contoured to provide successive portions of increased and reduced spacing between its inner surface and the outer cylindrical surface of said rotor, a plurality of radially moveably vane assemblies mounted on and projecting outwardly from the outer surface of said rotor body at equally spaced intervals therearound, bearing means between said rotor and stator bodies supporting each end of said rotor body for coaxial rotation within said stator, seal means axially outboard of each said bearing means sealing the space between said stator inner surface and said rotor outer surface, a pressure fluid port extending through said stator body adjacent the leading longitudinal edge of each increased spacing portion and an exhaust fluid port extending through said stator body adjacent the trailing edge of each said decreased spacing portion around said stator body, first conduit means for supplying hydraulic fluid under pressure to each of said pressure fluid ports to produce rotation of said rotor;

second conduit means for conducting hydraulic fluid from said exhaust ports upon rotation of said rotor, means urging said radially movable vane assemblies into continuous contact with said inner surfaces of said stator, said bearing means comprises a first race rigidly joined to and projecting outwardly from the outer surface of said rotor body and a second race mounted on and extending radially inward from said stator body in overlapping relation to said first race, and ball members disposed between said first and second races, and said seal means comprises a seal can mounted on said second bearing race, and a marine packing contained in a packing gland between said seal cap and said second bearing race.

2. The radial vane rotary device defined in claim 1, wherein the number of said radially movable vane assemblies is greater than the number of increased spacing portions and reduced spacing portions.

3. The radial vane rotary device defined in claim 1, wherein the spacing of said radially movable vanes and the spacing of said increased and reduced spacing portions is such that a movable vane is in contact with at least one said increased spacing portion at all times during rotation of said rotor in said stator.

4. The radial vane rotary device defined in claim 1, wherein said successive portions of increased and reduced spacing between said stator inner surface and the outer cylindrical surface of said rotor comprise a plurality of elongated metal plate members mounted and extending longitudinally of said stator, said plate members having arcuate inner and outer side surfaces, the outer side surface being complimentary to said stator body inner surface and wider than said inner side surface, and wherein the side edges of said plate members are tapered to provide a substantially smooth continuous inner surface including a ramp at each side engaging said movable vanes.

5. The radial vane rotary device defined in claim 4, wherein said plate members each comprises a longitudinal segment of a pipe having an outside diameter equal to the inside diameter of said stator body.

6. The radial vane rotary device defined in claim 4, wherein said pressure fluid ports and said exhaust ports each extend through a ramp portion of each of said plate members.

7. The radial vane rotary device defined in claim 1, wherein said stator has an oval or elliptical shape in transverse cross section, the major and minor axes of the oval or ellipse defining two areas of increased spacing and reduced spacing, respectively, between the surfaces of said rotor and stator.

8. The radial vane rotary device defined in claim 1, wherein said bearing means is capable of transmitting both radial and axial loads between said stator and said rotor.

9. The radial vane rotary device defined in claim 1, further comprising means resiliently urging said seal cap toward said second bearing race to thereby compress said marine packing.

10. The radial vane rotary device defined in claim 1, wherein said first and said second conduit means comprises first and second metal channels extending around and welded to the outer surface of said stator body in axially spaced relation to one another, said metal channels cooperating with the outer surface of the stator body to define a pair of pressure fluid channels for supplying pressure fluid to the device and permitting fluid to flow from the device.

11. The radial vane rotary device defined in claim 10, further comprising a pair of fluid conduits extending through said support structure and connected one to each said pressure fluid channel.

12. The radial vane rotary device defined in claim 1, further comprising a propeller having a plurality of radially extending blades mounted within and having its blade tips rigidly joined to said rotor body for rotation therewith.

13. The radial vane rotary device defined in claim 12, wherein said support structure comprises a tubular support post rigidly joined to the outer surface of said stator body for supporting the device on a marine vessel for propelling the vessel through the water.

14. The radial vane rotary device defined in claim 1, wherein said vane assemblies each comprises guide means mounted on said cylindrical outer surface of the rotor, said guide means defining an axially extending radially outwardly open guide groove, and a radially movable vane for radial sliding movement in said guide groove.

15. The radial vane rotary device defined in claim 14, further comprising vent means permitting the flow of pressure fluid into and out of said groove upon radial movement of said vane in said groove.

16. A marine propulsion unit comprising, a stator adapted to be mounted to a support structure, a rotor mounted for coaxial rotation within said stator, said rotor including an elongated generally tubular body with cylindrical inner and outer surfaces and open ends, said stator including an elongated generally tubular body having open ends and a continuous inner surface contoured to provide successive portions of increased and decreased spacing between its inner surface and the outer cylindrical surface of said rotor, a plurality of radially moveably vane assemblies mounted on and projecting outwardly from the outer surface of said rotor body at equally spaced intervals therearound, a propeller having a plurality of blades mounted within and having its blade tips rigidly joined to the inner surface of said rotor body for rotation therewith;

bearing means between said rotor and stator bodies supporting each end of said rotor for coaxial rotation within said stator, said bearing means being capable of transmitting both radical and axial loads between said rotor and stator, seal means axially outboard of each said bearing means sealing the space between said stator inner surface and said rotor outer surface, a pressure fluid port extending through said stator body adjacent the leading longitudinal edge of each said increased spacing portion and an exhaust fluid port extending through said stator body adjacent the trailing edge of each said deceased spacing portion around said stator body, first conduit means for supplying hydraulic fluid under pressure to each of said pressure fluid ports to produce rotation of said rotor;

second conduit means for conducting hydraulic fluid from said exhaust ports upon rotation of said rotor, means urging said radially movable vane assemblies into continuous contact with said inner surfaces of said stator, said vane assemblies each comprises guide means mounted on said cylindrical outer surface of the rotor, said guide means defining an axially extending radially outwardly open guide groove, and a radially movable vane for radial sliding movement in said guide groove, and vent means permitting the flow of pressure fluid into and out of said groove upon radial movement of said vane in said groove, and said vent means comprises a shuttle valve operable to permit pressure fluid to flow into and out of said groove from or to the high pressure side of the vane assembly upon rotation of the rotor in either direction in the stator.

17. The marine propulsion unit defined in claim 16, wherein said stator has an oval or elliptical shape in transverse cross section, the major and minor axes of the oval or ellipse defining two areas of increased spacing and reduced spacing, respectively, between the surfaces of said rotor and stator.

18. The marine propulsion unit defined in claim 16, further comprising means mounting the system on a marine vessel for rotation about an axis perpendicular to the axis of rotation of said rotor for steering the vessel.

* * * * *